US011466549B2

(12) United States Patent
Lee et al.

(10) Patent No.: US 11,466,549 B2
(45) Date of Patent: Oct. 11, 2022

(54) RESERVOIR STIMULATION COMPRISING HYDRAULIC FRACTURING THROUGH EXTENDED TUNNELS

(71) Applicant: Schlumberger Technology Corporation, Sugar Land, TX (US)

(72) Inventors: Donald W. Lee, Houston, TX (US); George Alan Waters, Oklahoma City, OK (US); Richard E. Lewis, Longmont, CO (US); Dmitriy Ivanovich Potapenko, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 102 days.

(21) Appl. No.: 16/475,751

(22) PCT Filed: Jan. 4, 2018

(86) PCT No.: PCT/US2018/012312
§ 371 (c)(1),
(2) Date: Jul. 3, 2019

(87) PCT Pub. No.: WO2018/129136
PCT Pub. Date: Jul. 12, 2018

(65) Prior Publication Data

US 2021/0131242 A1 May 6, 2021

Related U.S. Application Data

(60) Provisional application No. 62/442,240, filed on Jan. 4, 2017.

(51) Int. Cl.
*E21B 43/17* (2006.01)
*E21B 41/00* (2006.01)
(Continued)

(52) U.S. Cl.
CPC ..... *E21B 43/17* (2013.01); *E21B 41/0035* (2013.01); *E21B 43/26* (2013.01); *E21B 43/305* (2013.01)

(58) Field of Classification Search
CPC ..... E21B 43/17; E21B 41/0035; E21B 43/26; E21B 43/305
See application file for complete search history.

(56) References Cited

U.S. PATENT DOCUMENTS 2,731,414 A 1/1956 Binder, Jr.
2,808,109 A 10/1957 Kirk
(Continued)

FOREIGN PATENT DOCUMENTS

CN 102504292 A 6/2012
CN 105349166 A 2/2016
(Continued)

OTHER PUBLICATIONS

Alekseenko, O. P., Potapenko, D.I., Chemy, S.G., Esipov, D.V., Kuranakov, D.S., Lapin, V.N. "3-D Modeling of fracture initiation from perforated non-cemented wellbore", SPE J., vol. 18, No. 3, 589-600, 2013.

(Continued)

*Primary Examiner* — Silvana C Runyan

(57) ABSTRACT

A technique facilitates hydrocarbon fluid production. A well is formed in a subterranean region by drilling a borehole, e.g. a generally vertical wellbore. At least one tunnel is formed and oriented to extend outwardly from the borehole at least 10 feet into a formation surrounding the borehole. The orientation of the at least one tunnel is selected such that it extends at a desired angle with respect to a direction of horizontal stress in the formation. A fracture stimulation of the at least one tunnel is performed to create a network of fractures. The orientation of the at least one tunnel ensures
(Continued)

that the network of fractures extends through a target zone in a hydrocarbon bearing region of the formation.

20 Claims, 3 Drawing Sheets

(51) Int. Cl.
*E21B 43/26* (2006.01)
*E21B 43/30* (2006.01)

(56) References Cited

U.S. PATENT DOCUMENTS 3,282,337 A 11/1966 Pye
3,336,221 A 8/1967 Ralston
3,553,099 A 1/1971 Savage
3,704,750 A 12/1972 Miles
3,878,884 A 4/1975 Raleigh
3,892,274 A 7/1975 Dill
4,007,797 A 2/1977 Jeter
4,032,460 A 6/1977 Zilch et al.
4,036,732 A 7/1977 Irani et al.
4,046,668 A 9/1977 Farcasiu et al.
4,046,669 A 9/1977 Blaine et al.
4,108,760 A 8/1978 Williams et al.
4,139,450 A 2/1979 Hanson et al.
4,347,118 A 8/1982 Funk et al.
4,479,541 A 10/1984 Wang
4,519,463 A 5/1985 Schuh
4,613,631 A 9/1986 Espenscheid et al.
4,640,362 A 2/1987 Schellstede
4,666,683 A 5/1987 Brown et al.
4,848,486 A 7/1989 Bodine
4,977,961 A 12/1990 Avasthi
RE33,660 E 8/1991 Jelsma
5,261,489 A 11/1993 Jennings, Jr. et al.
5,335,726 A 8/1994 Rodrigues
5,358,051 A 10/1994 Rodrigues
5,373,906 A 12/1994 Braddick
5,868,210 A 2/1999 Johnson et al.
5,893,416 A 4/1999 Read
6,581,690 B2 6/2003 Van Drentham-Susman et al.
7,347,260 B2 3/2008 Ferguson et al.
7,422,059 B2 9/2008 Jelsma
7,431,083 B2 10/2008 Olsen
7,441,595 B2 10/2008 Jelsma
7,686,101 B2 3/2010 Belew et al.
7,788,037 B2 * 8/2010 Soliman ..... E21B 49/00 702/12
7,971,658 B2 7/2011 Buckman, Sr.
7,971,659 B2 7/2011 Gatlin et al.
8,167,060 B2 5/2012 Brunet et al.
8,201,643 B2 6/2012 Soby et al.
8,220,547 B2 7/2012 Craig et al.
8,372,786 B2 2/2013 Berkland et al.
8,408,333 B2 4/2013 Pai et al.
8,420,576 B2 4/2013 Eoff et al.
8,424,620 B2 4/2013 Perry, Jr. et al.
8,590,618 B2 11/2013 Jelsma
8,672,034 B2 3/2014 Al-Ajmi et al.
8,770,316 B2 7/2014 Jelsma
9,121,272 B2 9/2015 Potapenko et al.
9,567,809 B2 2/2017 Savage
9,803,134 B2 10/2017 De Wolf et al.
9,976,351 B2 5/2018 Randall
10,005,955 B2 6/2018 Beuterbaugh et al.
2002/0005286 A1 1/2002 Mazorow et al.
2003/0062167 A1 4/2003 Surjaatmadja et al.
2005/0056418 A1 3/2005 Nguyen
2005/0230107 A1 10/2005 McDaniel et al.
2006/0048946 A1 3/2006 Al-Muraikhi
2006/0070740 A1 4/2006 Surjaatmadja et al.
2006/0102343 A1 5/2006 Skinner et al.
2007/0261852 A1 11/2007 Surjaatmadja et al.
2007/0261887 A1 11/2007 Pai et al.
2008/0078548 A1 4/2008 Pauls et al.
2008/0135292 A1 6/2008 Sihler et al.
2008/0139418 A1 6/2008 Cioletti et al.
2009/0017678 A1 1/2009 Meier et al.
2009/0065253 A1 3/2009 Suarez-Rivera et al.
2009/0101414 A1 4/2009 Brunet et al.
2009/0114385 A1 5/2009 Lumbye
2009/0250211 A1 10/2009 Craig
2009/0288884 A1 11/2009 Jelsma
2010/0126722 A1 5/2010 Cornelissen et al.
2010/0187012 A1 7/2010 Belew et al.
2010/0243266 A1 9/2010 Soby et al.
2010/0282470 A1 11/2010 Alberty et al.
2011/0005762 A1 1/2011 Poole
2011/0017468 A1 1/2011 Birch et al.
2011/0061869 A1 * 3/2011 Abass ..... E21B 43/305 166/308.1
2011/0067871 A1 3/2011 Burdette et al.
2011/0068787 A1 3/2011 Freedman et al.
2011/0147088 A1 6/2011 Brunet et al.
2012/0024530 A1 * 2/2012 Todd ..... C09K 8/03 166/308.1
2012/0067646 A1 3/2012 Savage
2012/0160567 A1 6/2012 Belew et al.
2012/0325555 A1 12/2012 Jette et al.
2013/0000908 A1 1/2013 Walters et al.
2013/0032349 A1 * 2/2013 Alekseenko ..... E21B 43/26 166/308.1
2013/0062125 A1 3/2013 Savage
2013/0213716 A1 8/2013 Perry et al.
2013/0220606 A1 8/2013 Yhuel et al.
2013/0233537 A1 9/2013 McEwen-King et al.
2013/0304444 A1 11/2013 Strobel et al.
2013/0341029 A1 12/2013 Roberts et al.
2014/0096950 A1 4/2014 Pyecroft et al.
2014/0096966 A1 4/2014 Freitag
2014/0102708 A1 4/2014 Purkis et al.
2014/0144623 A1 5/2014 Pyecroft et al.
2014/0340082 A1 11/2014 Yang et al.
2015/0007988 A1 1/2015 Ayasse
2015/0096748 A1 4/2015 West
2015/0107825 A1 4/2015 Miller et al.
2015/0218925 A1 8/2015 Lecampion et al.
2015/0337613 A1 11/2015 Belew et al.
2015/0356403 A1 12/2015 Storm, Jr.
2016/0053597 A1 2/2016 Brown et al.
2016/0115772 A1 4/2016 Graham et al.
2016/0131787 A1 5/2016 Quirein et al.
2016/0153239 A1 * 6/2016 Randall ..... E21B 41/0078 175/4.57
2016/0160619 A1 6/2016 Randall
2016/0215581 A1 7/2016 Ingraham et al.
2016/0281480 A1 9/2016 Pyecroft et al.
2016/0312587 A1 10/2016 Montaron et al.
2017/0030180 A1 2/2017 Maurer
2017/0204713 A1 7/2017 Bell et al.
2018/0023375 A1 1/2018 Potapenko et al.
2018/0112468 A1 4/2018 Savage et al.
2018/0163122 A1 6/2018 Panga et al.
2018/0306017 A1 10/2018 Savage
2018/0328118 A1 11/2018 Morse et al.
2019/0017358 A1 1/2019 Morse et al.
2020/0157901 A1 5/2020 Cardon et al.

FOREIGN PATENT DOCUMENTS

EP 2631422 A2 8/2013
EP 2672409 A2 12/2013
EP 2198119 B1 10/2017
GB 2406863 A 4/2005
WO 9113177 A1 9/1991
WO 9420727 A1 9/1994
WO 0046484 A1 8/2000
WO 03050377 A2 6/2003
WO 2004046494 A2 6/2004
WO 2005090747 A1 9/2005
WO 2009096805 A1 8/2009
WO 2009157812 A1 12/2009

(56) References Cited

FOREIGN PATENT DOCUMENTS

| | | | |
|---|---|---|---|
| WO | 2013019390 | A1 | 2/2013 |
| WO | 2015089458 | A1 | 6/2015 |
| WO | 2016138005 | A1 | 9/2016 |
| WO | 2017074722 | A1 | 5/2017 |
| WO | 2017078989 | A1 | 5/2017 |
| WO | 2018049311 | A1 | 3/2018 |
| WO | 2018049367 | A1 | 3/2018 |
| WO | 2018049368 | A1 | 3/2018 |
| WO | 2019014160 | A1 | 1/2019 |
| WO | 2019014161 | A1 | 1/2019 |
| WO | 2019168885 | A1 | 9/2019 |
| WO | 2019241454 | A1 | 12/2019 |
| WO | 2019241455 | A1 | 12/2019 |
| WO | 2019241456 | A1 | 12/2019 |
| WO | 2019241457 | A1 | 12/2019 |
| WO | 2019241458 | A1 | 12/2019 |

OTHER PUBLICATIONS

Alekseenko O.P. , Potapenko D.I. , Kuranakov D.S., Lapin V.N., Cherny S.G., and Esipov D.V. "3D Modeling of Fracture Initiation from Cemented Perforated Wellbore", presented at 19th European Conference on Fracture, Kazan, Russia, Aug. 26-31, 2012.

Potyondy, "Simulating stress corrosion with a bonded-particlle model for rock", International Journal of Rock Mechanics and Mining Sciences, vol. 44, Issue 5, Jul. 2007, pp. 677-691.

Atkinson et al., "Acoustic Emission During Stress Corrosion Cracking in Rocks", Earthquake Prediction: An International Review, vol. 4, pp. 605-616, 1981.

Wikipedia.org, "Wood's metal", edited May 4, 2019, Accessed Jul. 3, 2019; https://en.wikipedia.org/wiki/Wood%27s_metal.

Pinto, I.S.S. et al., "Biodegradable chelating agents for industrial, domestic, and agricultural applications—a review", Environmental Science and Pollution Research, 2014, 21, pp. 11893-11906.

Office Action received in U.S. Appl. No. 16/629,992 dated Apr. 21, 2021, 53 pages.

Office Action received in U.S. Appl. No. 16/629,992 dated Jan. 18, 2022, 11 pages.

Office Action issued in Eurasian Patent Application No. 201991640 dated Nov. 17, 2021, 4 pages with English translation.

Office Action issued in U.S. Appl. No. 16/332,418 dated Nov. 29, 2021, 12 pages.

Office Action issued in Kuwait patent application No. KW/P/2019/221 dated Oct. 13, 2021, 6 pages.

2nd Office Action issued in Chinese patent application 201880014781.6 dated Oct. 22, 2021, 23 pages with English Translation.

* cited by examiner

RESERVOIR STIMULATION COMPRISING HYDRAULIC FRACTURING THROUGH EXTENDED TUNNELS

CROSS-REFERENCE TO RELATED APPLICATION

The present document is based on and claims priority to U.S. Provisional Application Ser. No. 62/442,240, filed Jan. 4, 2017, which is incorporated herein by reference in its entirety.

BACKGROUND

In various well applications, the subterranean formation is stimulated to enhance recovery of hydrocarbon fluids such as oil and gas. One form of well stimulation is hydraulic fracturing which may be conducted in a wellbore following a drilling operation and an optional casing operation. Hydraulic fracturing operations initially were performed in single stage vertical or near vertical wells. To further improve productivity, however, hydraulic fracturing operations have trended toward use in generally horizontal wells. Although horizontal fracturing operations have improved productivity, current methods have limitations with respect to productivity and efficiency in certain types of subterranean environments and operations.

SUMMARY

In general, the present disclosure provides a methodology and system for enhancing hydrocarbon fluid production. A well is formed in a subterranean region by drilling a borehole, e.g. a generally vertical wellbore. At least one tunnel, e.g. two tunnels, may be formed and oriented to extend outwardly from the borehole at least 10 feet into a formation surrounding the borehole. The orientation of the tunnels is selected such that the tunnels extend at a desired azimuthal orientation and/or deviation. For example, the orientation of the tunnels may be selected with respect to a direction of maximum horizontal stress in the formation. A fracture stimulation of the tunnels is performed to create a network of fractures. The orientation of the tunnels ensures that the network of fractures extends through a target zone in a hydrocarbon bearing region of the formation.

BRIEF DESCRIPTION OF THE DRAWINGS

Certain embodiments will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

Figure 1:
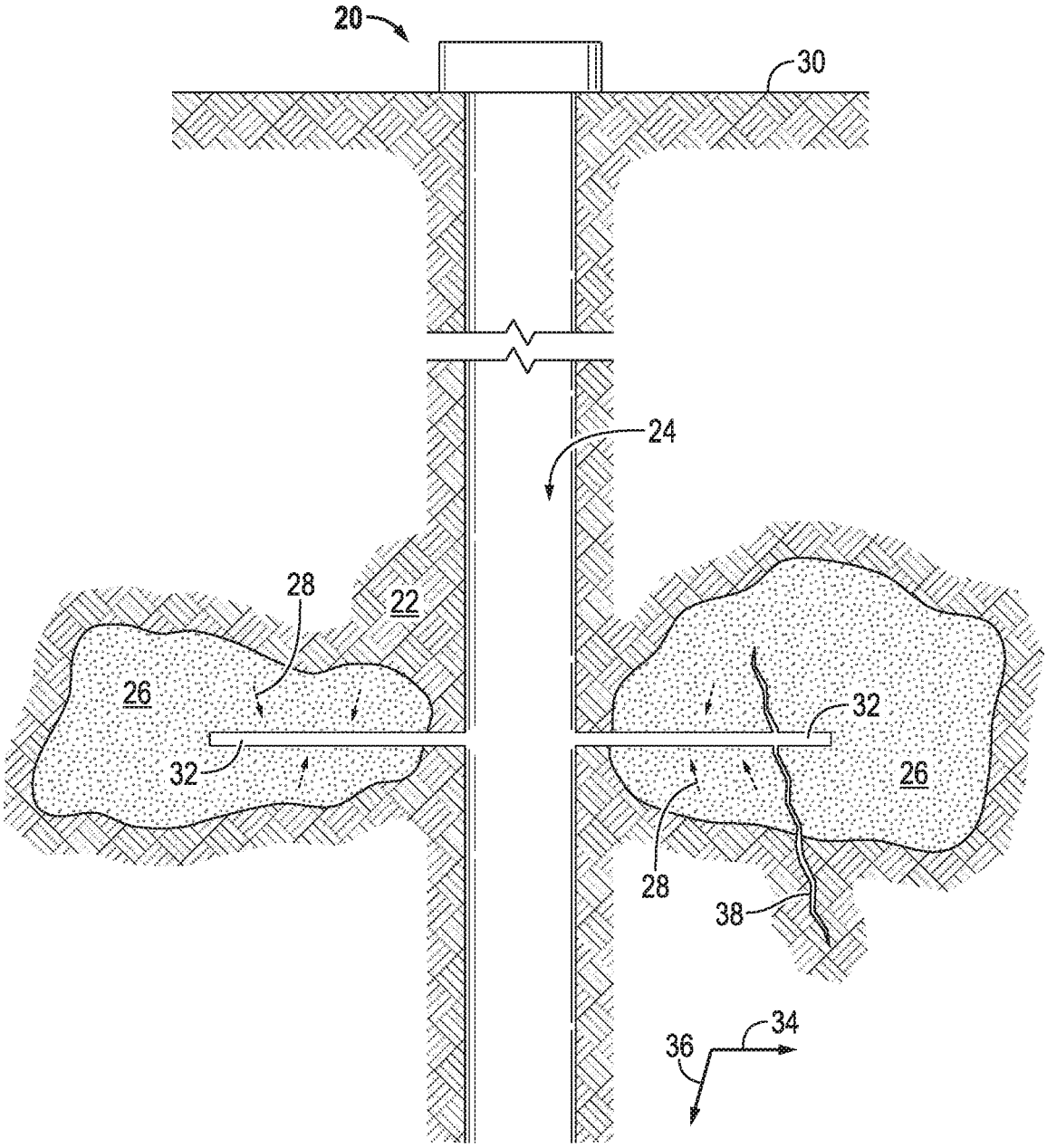
FIG. 1 is a schematic illustration of an example of a well system having a generally vertical borehole and a plurality of tunnels extending from the borehole, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a methodology and system for enhancing hydrocarbon fluid production. A well is formed in a subterranean region by drilling a borehole, e.g. a generally vertical wellbore. At least one tunnel, e.g. at least two tunnels, may be formed and oriented to extend outwardly from the borehole at least 10 feet into a formation surrounding the borehole. In some operations, the tunnels may be formed to extend outwardly from the borehole at least 15 feet and in other operations at least 20 feet. For example, some applications may utilize tunnels substantially longer than 20 feet. In various formations, the borehole is oriented generally vertically and the tunnels extend outwardly generally horizontally. However, some applications may utilize a deviated, e.g. horizontal, borehole with tunnels extending outwardly from the deviated borehole. Depending on the application and characteristics of the subterranean region, the tunnels may be oriented generally horizontally, generally vertically, or at desired orientations therebetween.

The orientation of the tunnels may be selected such that each tunnel extends at a desired angle with respect to a direction of principal stresses in the formation. For example, the tunnel azimuths may be oriented in a direction of maximum horizontal stress, minimum horizontal stress, or at a desired other angle with respect to the maximum horizontal stress. Additionally, the tunnel azimuths (as well as the borehole azimuth) may be constant but they may also vary in some applications, e.g. to achieve a desired positioning with respect to a hydrocarbon bearing target zone in a formation.

Once the tunnels are formed, a fracture stimulation of the tunnels may be performed to create a network of fractures. For example, a hydraulic fracturing fluid may be pumped downhole and out through the tunnel or tunnels to create fracture networks extending from each tunnel. The fracture networks may be formed to extend laterally from each tunnel but they also may be formed parallel with the tunnels and/or at other desired orientations. The orientation of the tunnels ensures that the network of fractures extends through a target zone in a hydrocarbon bearing region of the formation.

The diameter of the tunnels may vary according to the formation and/or other parameters of a given operation. By way of example, the tunnels are generally smaller in diameter than casing used along the borehole from which they extend. In some operations, the tunnel diameters may be 2 inches or less and in other operations the tunnel diameters may be 1.5 inches or less. However, some embodiments may utilize tunnels equal to or larger in diameter than the borehole. The diameter of the tunnels may be selected according to parameters of the formation and/or types of equipment used for forming the tunnels. Also, the resultant diameter of the tunnels may vary depending on the technique used to form the tunnels, e.g. drilling, jetting, or other suitable technique.

In some embodiments, the borehole may be drilled at least in part in a non-productive zone of the subterranean formation. The non-productive zone may be a zone which contains limited amounts of hydrocarbon fluid or is less desirable with respect to production of hydrocarbon fluid. Depending on the characteristics of the subterranean region, the borehole may be drilled in nonproductive rock and/or in a region with petrophysical and geo-mechanical properties different from the properties of the target zone. For example, the borehole may be drilled in a region of the formation having a substantially higher minimum in situ stress relative to that of the target zone. It should be noted the tunnels may be used in many types of formations, e.g. laminated formations, to facilitate flow of fluid to the tunnels through fracture networks even in the presence of pinch points between formation layers.

To facilitate production, at least one tunnel is formed which intersects the borehole and extends into a target zone, e.g. a productive zone containing hydrocarbon fluid. Often, a plurality of tunnels, e.g. at least two tunnels, may be formed to extend from the borehole outwardly into the target zone to serve as extended treatment passages. The target zone may be a single region or separate distinct regions of the formation. In some applications, the borehole may be entirely outside of the target zone and a plurality of tunnels may be formed in desired directions to reach the target zone. For example, the tunnels may be formed generally horizontally, generally vertically, generally along desired angles between horizontal and vertical, in generally opposed directions with respect to each other, or at other orientations with respect to each other. In other applications, however, the borehole may extend into or through the target zone.

As described above, the well stimulation may comprise a hydraulic fracturing of the stimulation zone or zones. During hydraulic fracturing, a fracturing fluid may be pumped down through the borehole and out through the plurality of tunnels. The fracturing fluid is forced under pressure from the tunnels out into the surrounding subterranean formation, e.g. into the surrounding hydrocarbon bearing target zone, to fracture the surrounding subterranean formation. For example, the surrounding subterranean formation may be fractured at a plurality of stimulation zones within the overall target zone.

It should be noted the fracturing fluid also may comprise propping agent for providing fracture conductivity after fracture closure. In certain embodiments, the fracturing fluid may comprise acid such as hydrochloric acid, acetic acid, citric acid, hydrofluoric acid, other acids, or mixtures thereof. The fracturing of the stimulation zones within the target zone enhances production of hydrocarbon fluid from the target zone to the wellbore and ultimately to the surface. The target zone may be a productive zone of the subterranean region containing desired hydrocarbon fluid, e.g. oil and/or gas.

Referring generally to FIG. 1, an embodiment of a well system 20 is illustrated as extending into a subterranean formation 22. The well system 20 enables a methodology for enhancing recovery of hydrocarbon fluid, e.g. oil and/or gas, from a well. In this embodiment, a borehole 24, e.g. a generally vertical wellbore, is drilled down into the subterranean formation 22. The borehole 24 may be drilled into or may be drilled outside of a target zone 26 (or target zones 26) containing, for example, a hydrocarbon fluid 28.

In the example illustrated, the borehole 24 is a generally vertical wellbore extending downwardly from a surface 30. However, some operations may form deviations in the borehole 24, e.g. a lateral section of the borehole 24, to facilitate hydrocarbon recovery. In some embodiments, the borehole 24 may be formed in nonproductive rock of formation 22 and/or in a zone with petrophysical and geo-mechanical properties different from the properties found in the target zone or zones 26.

At least one tunnel 32, e.g. a plurality of tunnels 32, may be formed to intersect the borehole 24. In the example illustrated, at least two tunnels 32 are formed to intersect the borehole 24 and to extend outwardly from the borehole 24. For example, the tunnels 32 may be formed and oriented laterally, e.g. generally horizontally, with respect to the borehole 24. Additionally, the tunnels 32 may be oriented to extend from borehole 24 in different directions, e.g. opposite directions, so as to extend into the desired target zone or zones 26.

The tunnels 32 provide fluid communication with an interior of the borehole/wellbore 24 to facilitate flow of the desired hydrocarbon fluid 28 from tunnels 32, into borehole 24, and up through borehole 24 to, for example, a collection location at surface 30. Furthermore, the tunnels 32 may be oriented in selected directions based on the material forming subterranean formation 22 and on the location of desired target zones 26.

Depending on the characteristics of the subterranean formation 22 and target zones 26, the tunnels 32 may be formed along various azimuths. For example, the tunnels 32 may be formed in alignment with a direction of maximum horizontal stress, represented by arrow 34, in formation 22. However, the tunnels may be formed along other azimuths such as in alignment with a direction of minimum horizontal stress in the formation, as represented by arrow 36.

In some embodiments, the tunnels 32 may be formed at a desired angle or angles with respect to principal stresses when selecting azimuthal directions. According to an example, the tunnel or tunnels 32 may be oriented at a desired angle with respect to the maximum horizontal stress in formation 22. It should be noted the azimuth and/or deviation of an individual tunnel 32 may be constant but the azimuth and/or deviation also may vary along the individual tunnel 32 to, for example, enable formation of the tunnel through a desired zone to facilitate recovery of hydrocarbon fluids 28.

Additionally, at least one of the tunnels 32 may be formed and oriented to take advantage of a natural fracture 38 or multiple natural fractures 38 which occur in formation 22. The natural fracture 38 may be used as a flow conduit which facilitates flow of the hydrocarbon fluid 28 into the tunnel or tunnels 32. Once the hydrocarbon fluid 28 enters the tunnels 32, the fluid is able to readily flow into wellbore 24 for production to the surface or other collection location.

Depending on the parameters of a given formation 22 and hydrocarbon recovery operation, the diameter and length of tunnels 32 also may vary. The tunnels 32 are generally longer than the lengths of perforations formed in a conventional perforation operation. According to an embodiment, the tunnels 32 extend from the borehole 24 at least 10 feet into the formation 22 surrounding the borehole 24. However, some embodiments of the methodology utilize tunnels 32 which extend from the borehole 24 at least 15 feet into the formation 22. Other embodiments of the methodology utilize tunnels 32 which extend from the borehole 24 at least 20 feet into the formation 22. For example, some embodiments may utilize tunnels substantially longer than 20 feet.

Each tunnel 32 also has a diameter generally smaller than the diameter of borehole 24, e.g. smaller than the diameter of casing which may be used to line borehole 24. With respect to diameter, various embodiments utilize tunnels 32 having a diameter of 2 inches or less. However, some embodiments of the methodology utilize tunnels 32 having a diameter of 1.5 inches or less. The actual lengths, diameters, and orientations of tunnels 32 may be adjusted according to the parameters of the formation 22, target zones 26, and objectives of the hydrocarbon recovery operation.

Figure 2:
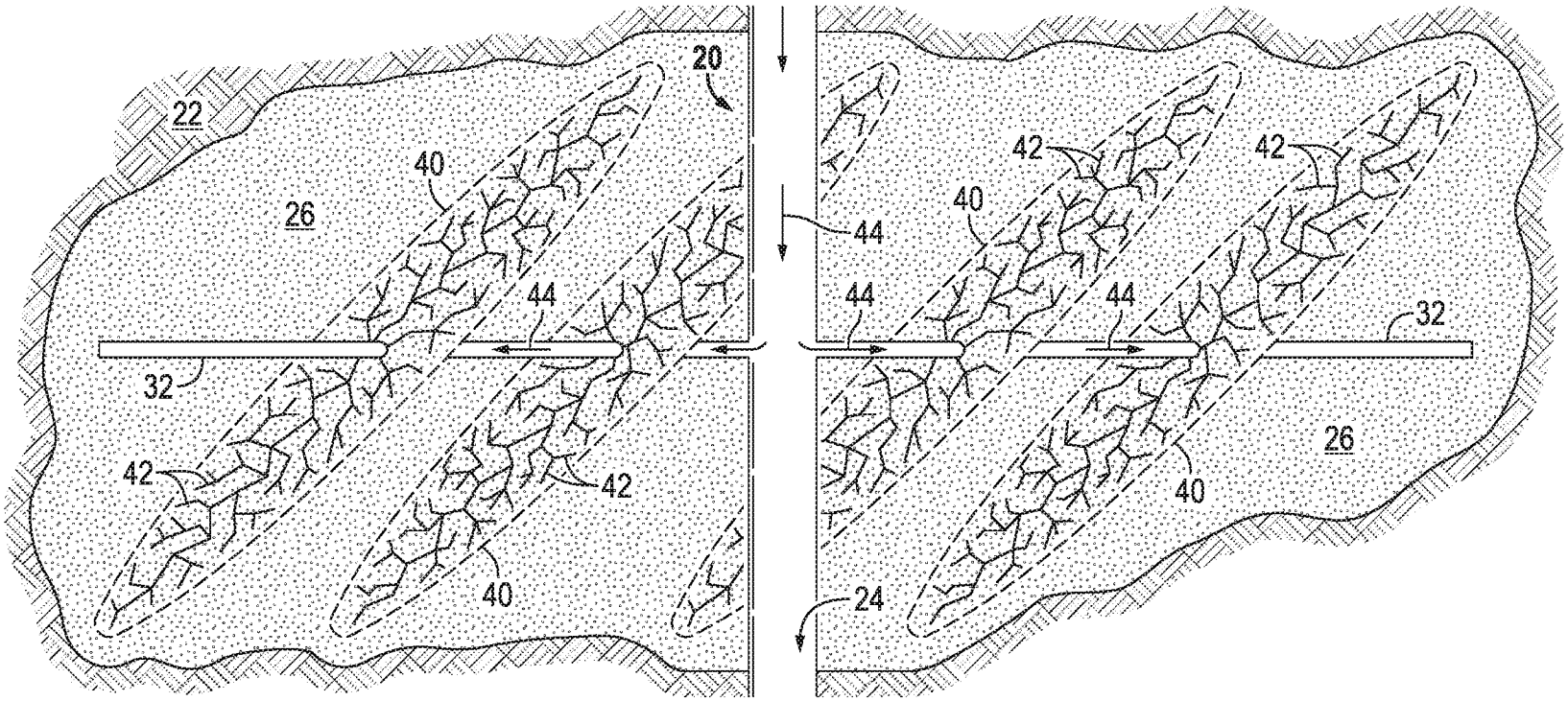
FIG. 2 is another schematic illustration of an example of a well system with a borehole and a plurality of tunnels, according to an embodiment of the disclosure.

With additional reference to FIG. 2, a stimulation operation may be performed via tunnels 32 to deliver stimulating fluid to stimulation zones 40 which are distributed through the target zone(s) 26. Distributing the stimulating fluid under pressure to the stimulation zones 40 creates fracture networks 42. The fracture networks 42 facilitate flow of fluid into the corresponding tunnels 32. By way of example, the stimulation operation may comprise hydraulic fracturing performed to fracture the subterranean formation 22, e.g. oil or gas bearing target zone 26, so as to facilitate flow of the desired fluid along the resulting fracture networks 42 and into the corresponding tunnels 32.

If the stimulation operation is a hydraulic fracturing operation, fracturing fluid may be pumped from the surface under pressure, down through wellbore 24, into tunnels 32, and then into the stimulation zones 40 surrounding the corresponding tunnels 32 as indicated by arrows 44. The pressurized fracturing fluid 44 causes formation 22 to fracture in a manner which creates the fracture networks 42 in stimulation zones 40. According to an embodiment, the tunnels 32/zones 40 may be fractured sequentially. For example, the fracturing operation may be performed through sequential tunnels 32 and/or sequentially through individual tunnels 32 to cause sequential fracturing of the stimulation zones 40 and creation of the resultant fracture networks 42.

The tunnels 32 may be formed via a variety of techniques, such as various drilling techniques or jetting techniques. For example, drilling equipment may be deployed down into wellbore 24 and used to form the desired number of tunnels 32 in appropriate orientations for a given subterranean environment and production operation. However, the tunnels 32 also may be formed by other suitable techniques, such as jetting techniques, laser techniques, injection of reactive fluid techniques, electrical decomposition techniques, or other tunnel formation techniques. In a specific example, the tunnels 32 may be jetted using hydraulic jetting technology similar to hydraulic jetting technologies available from Radial Drilling Services Ltd, Viper Drill of Houston Tex., Jett-Drill Well Services Ltd, or Fishbones AS of Stavanger Norway.

The use of tunnels 32 during the stimulation operation enables creation of fracture networks 42. The fracture networks 42 provide fractures with an increased density, thus increasing the size of the contact area with respect to each target zone 26 containing hydrocarbon fluid 28. This, in turn, leads to an increase in well productivity compared to wells completed without utilizing tunnels 32.

Figure 3:
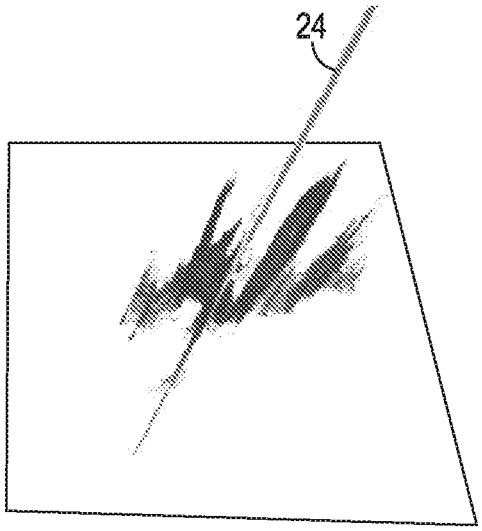
FIG. 3 is a graphical illustration showing a fracture geometry created from a vertical borehole, according to an embodiment of the disclosure.
Figure 4:
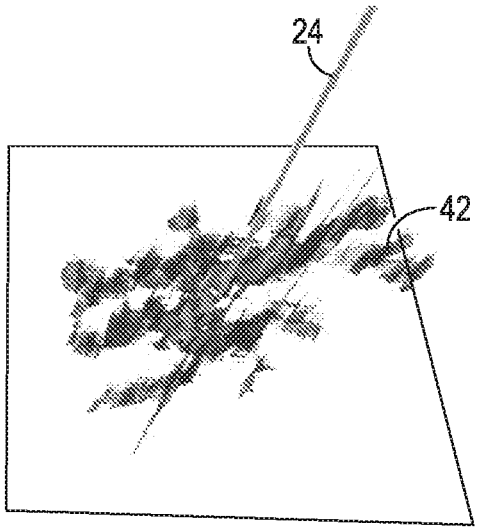
FIG. 4 is a graphical illustration showing a fracture geometry created from a plurality of tunnels extending laterally from a vertical borehole, according to an embodiment of the disclosure.

As illustrated graphically in FIGS. 3 and 4, for example, the fracture geometry of a vertical well perforated and fractured without tunnels 32 (see FIG. 3) is substantially smaller and less dense than the fracture geometry of a vertical well with opposed tunnels 32 which was hydraulically fractured via the tunnels 32 to create the fracture networks 42 (see FIG. 4). According to modeled fracture geometry and well production computations (including orientation of extended tunnels 32), the fracture networks 42 resulting from fracturing via tunnels 32 substantially improves productivity. According to one example, performing hydraulic fracturing via extended tunnels 32 initiates fractures in transverse directions and increases the well productivity substantially, e.g. by 33% or more, compared to a well which is fracture stimulated without use of the tunnels 32.

Figure 5:
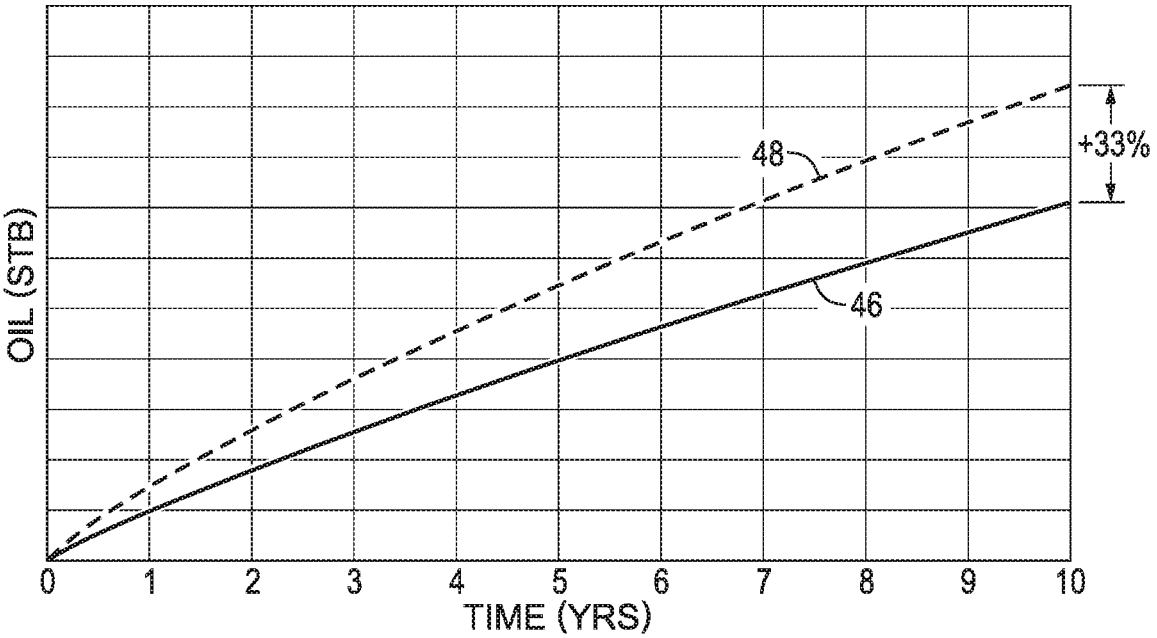
FIG. 5 is a graphical illustration comparing predicted barrels of oil produced from a fractured vertical borehole versus fractured lateral tunnels extending from a vertical borehole, according to an embodiment of the disclosure.

The projected oil production from such wells is illustrated graphically in FIG. 5. In FIG. 5, graph line 46 corresponds to projected production resulting from a fracturing operation without tunnels 32 and graph line 48 corresponds to projected production resulting from a fracturing operation utilizing tunnels 32 to create the fracture networks 42 in stimulation zones 40. The projections are based on a comparison of flow resulting from different test applications combined with modeling of the stimulation techniques.

In an operational example, the orientation of tunnels 32 may be determined based on various well productivity considerations prior to creating the tunnels 32. For example, the tunnels 32 may be created in the direction of maximum horizontal stress to enable formation of fractures which are aligned with the direction of such tunnels 32. In other embodiments, the extended tunnels 32 may be created in a direction perpendicular to a direction of maximum horizontal stress information 22 to enable creation of fractures oriented perpendicular to the direction of tunnels 32.

The tunnels 32 also may be placed at an angle to the principal horizontal stresses such that the created fractures are oblique with respect to the tunnels 32. As described above, individual tunnels 32 also may be oriented to intersect natural fractures 38 within the formation 22 which may be further activated during subsequent stimulation. In some embodiments, the tunnels 32 may be formed at a desired angle with respect to a horizontal plane.

It should be noted production levels corresponding to various orientations of the tunnels 32 can be forecast by employing various well production modeling techniques using software products such as Kinetix™ available from Schlumberger Corporation, Gohfer® available from Barree & Associates, or other suitable software products. Depending on the parameters of a given operation, the wellbore 24 may be an open hole, a cased hole with packers and port collars, or a wellbore with a cased and cemented completion. The tunnels 32 may be formed as extended treatment passages and may be created prior to or subsequent to casing the wellbore 24.

Use of tunnels 32 and the stimulation techniques described herein also may be employed to reduce the amount of sand and material delivered downhole in a variety of fracturing operations while still enhancing production of the desired hydrocarbon fluids. Although the tunnels 32 effectively increase production via vertical wellbore 24, the tunnels 32 and stimulation techniques described herein may be used in vertical wells and deviated wells, e.g. horizontal wells, in unconventional or conventional formations.

Depending on the parameters of a given application, the wellbore geometries described herein may be adjusted according to the type, size, orientation, and other features of the target zone or zones 26. Additionally, the location of the borehole 24 as well as the tunnels 32 may be affected by the type of non-productive zones adjacent the target zone(s) 26 containing desired hydrocarbon fluids 28. Similarly, many different types of equipment, e.g. packers, valves, sleeves, sand screens, and/or other types of equipment may be used in completing the wellbore 24. Various sections of the wellbore 24 may be cased or open-hole depending on the parameters of the specific application.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for enhancing hydrocarbon fluid production, comprising:

drilling a generally vertical borehole in a formation zone;

forming a tunnel extending outwardly from the generally vertical borehole at least 10 feet into a formation surrounding the generally vertical borehole by utilizing a one of drilling and hydraulic jetting;

orienting the tunnel to intersect the formation zone at a predetermined angle with respect to a direction of maximum horizontal stress in the formation zone, wherein the predetermined angle is determined by a forecast production level from a well production modeling technique; and performing a fracture stimulation of the tunnel to create a network of fractures through a target zone which is a hydrocarbon bearing region of the formation, wherein an azimuth of the tunnel is selected with respect to the target zone to ensure that the network of fractures extends through the target zone when performing the fracture stimulation.

2. The method as recited in claim 1, wherein forming the tunnel comprises forming at least two tunnels with diameters of less than 2 inches.

3. The method as recited in claim 1, wherein forming the tunnel comprises forming at least two tunnels with diameters of less than 1.5 inches.

4. The method as recited in claim 1, wherein forming the tunnel comprises forming at least two tunnels in alignment with a direction of maximum horizontal stress in the formation.

5. The method as recited in claim 1, wherein forming the tunnel comprises forming at least two tunnels in alignment with a direction of minimum horizontal stress in the formation.

6. The method as recited in claim 1, wherein forming the tunnel comprises forming at least two tunnels in a substantially horizontal orientation.

7. The method as recited in claim 1, wherein drilling comprises drilling the generally vertical borehole outside of the target zone.

8. The method as recited in claim 1, wherein performing the fracture stimulation comprises performing a hydraulic fracture operation.

9. The method as recited in claim 1, wherein forming comprises orienting the tunnel to intersect a natural fracture.

10. A method, comprising:

drilling a borehole in a formation zone having different petrophysical and geo-mechanical properties than at least one target zone in a hydrocarbon bearing formation;

forming a first tunnel extending from the borehole laterally and a second tunnel extending from the borehole laterally in a different direction than the first tunnel, wherein forming comprises utilizing a one of drilling and hydraulic jetting;

orienting the first tunnel and the second tunnel to intersect the at least one target zone at a predetermined angle with respect to a direction of maximum horizontal stress in the hydrocarbon bearing formation, wherein the predetermined angle is determined by a forecast production level from a well production modeling technique; and performing a hydraulic fracture stimulation of the first tunnel and the second tunnel to create a network of fractures through the target zone of the hydrocarbon bearing formation and thereby facilitate flow of hydrocarbons from the target zone of the hydrocarbon bearing formation through the first and second tunnels and into the borehole.

11. The method as recited in claim 10, wherein orienting the first and second tunnels comprises orienting the first and second tunnels at desired angles with respect to horizontal stresses in the hydrocarbon bearing formation.

12. The method as recited in claim 10, wherein orienting the first and second tunnels comprises orienting the first and second tunnels in alignment with a direction of maximum horizontal stress in the hydrocarbon bearing formation.

13. The method as recited in claim 10, wherein orienting the first and second tunnels comprises orienting the first and second tunnels in alignment with the direction of minimum horizontal stress in the hydrocarbon bearing formation.

14. The method as recited in claim 10, wherein orienting the first and second tunnels comprises orienting at least one of the first and second tunnels to intersect a natural fracture.

15. The method as recited in claim 10, wherein forming the first and second tunnels comprises forming the first and second tunnels to extend laterally at least 10 feet.

16. The method as recited in claim 10, wherein drilling comprises drilling a generally vertical borehole and wherein orienting the first and second tunnels comprises orienting the first and second tunnels to extend outwardly from the generally vertical borehole.

17. The method as recited in claim 10, wherein drilling comprises drilling a generally horizontal borehole and wherein orienting the first and second tunnels comprises orienting the first and second tunnels to extend outwardly from the generally horizontal borehole.

18. A system to enhance hydrocarbon production, comprising:

a generally vertical wellbore having a wellbore diameter in a formation containing a hydrocarbon bearing target zone;

at least two tunnels each having a tunnel diameter less than the wellbore diameter, wherein the tunnel diameter is 2 inches or less and extends laterally from the wellbore at least 10 feet, the at least two tunnels being formed by a one of drilling and hydraulic jetting and extending into the hydrocarbon bearing target zone, and wherein the at least two tunnels are oriented to intersect the hydrocarbon bearing target zone at predetermined angles with respect to a direction of maximum horizontal stress in the formation, wherein the predetermined angle is determined by a forecast production level from a well production modeling technique; and a fracture network extending laterally from each tunnel of the at least two tunnels.

19. The system as recited in claim 18, wherein the at least two tunnels extend at least 15 feet from the generally vertical wellbore.

20. The system as recited in claim 19, wherein the at least two tunnels are oriented generally horizontally in opposed directions and extend at least 20 feet from the generally vertical wellbore.

* * * * *